United States Patent [19]

Csaszar et al.

[11] 4,029,064

[45] June 14, 1977

[54] CARBURETION SYSTEM FOR INTERNAL COMBUSTION ENGINES

[75] Inventors: Gabor Csaszar; Gernot Oehley, both of Chicago, Ill.

[73] Assignees: Irving J. Grace; Geraldine Grace

[22] Filed: Mar. 18, 1976

[21] Appl. No.: 668,147

[52] U.S. Cl. ..... 123/119 E; 123/119 EE; 123/119 R; 261/DIG. 48

[51] Int. Cl.[2] ..... F02M 27/08; B05D 3/14

[58] Field of Search ..... 123/119 E, 119 EE, 198 E, 123/119 R, 141; 261/DIG. 48; 48/180 M, 144

[56] References Cited

UNITED STATES PATENTS

| | | | |
|---|---|---|---|
| 1,939,302 | 12/1933 | Heaney | 123/119 E |
| 2,414,494 | 1/1947 | Vang | 123/119 E |
| 2,732,835 | 1/1956 | Hundt | 123/198 E |
| 2,745,372 | 5/1956 | Chertoff | 123/119 E |
| 2,907,648 | 10/1959 | Chapman | 261/DIG. 48 |
| 2,908,443 | 10/1959 | Fruengel | 123/119 EE |
| 3,326,538 | 6/1967 | Merritt | 261/DIG. 48 |
| 3,451,379 | 6/1969 | Kuribayashi et al. | 123/119 E |
| 3,533,606 | 10/1970 | Thatcher | 261/DIG. 48 |
| 3,613,649 | 10/1971 | Ilford et al. | 123/119 E |
| 3,745,983 | 7/1973 | Sweeney | 123/119 R |
| 3,780,945 | 12/1973 | Hughes | 123/119 E |
| 3,860,173 | 1/1975 | Sata | 123/119 E |
| 3,955,545 | 5/1976 | Priegel | 123/119 E |

FOREIGN PATENTS OR APPLICATIONS

| | | | |
|---|---|---|---|
| 45-17485 | 6/1970 | Japan | 261/DIG. 48 |
| 508,582 | 7/1939 | United Kingdom | 123/119 E |
| 1,138,536 | 1/1969 | United Kingdom | 123/119 E |

OTHER PUBLICATIONS

Popular Science Magazine, Mar. 1973, pp. 89, 90, 91, 145.4

*Primary Examiner*—Wendell E. Burns
*Attorney, Agent, or Firm*—Allegretti, Newitt, Witcoff & McAndrews

[57] ABSTRACT

A device for mounting on the inlet manifold of an internal combustion engine for carbureting liquid fuel. A chamber is provided for receiving the liquid fuel. An ultrasonic generator is positioned in the chamber and is in direct communcation with the liquid fuel in the chamber. The ultrasonic generator acts to ultrasonically vaporize the fuel in the chamber, preferably by an electronic control system. The receiving chamber is interconnected to a gasified fuel storage chamber which acts to store a quantity of vaporized liquid fuel. The storage chamber and the receiving chamber are interconnected for passing vaporized liquid fuel from the receiving chamber to the storage chamber. A monitoring device is provided, preferably an optical density detector, for determining the quantity, as well as the density, of the vaporized fuel in the vaporized fuel storage chamber and a control system responsive to the monitoring device, is provided for controlling the amount of ultrasonic energy used for vaporizing the amount of fuel required for use in the internal combustion engine, as determined by the engine load demand. An air collector is provided for communicating air with the vaporized fuel and also with the receiving chamber for the liquid fuel. A chamber and control valve are provided for regulating the quantity of the vaporized fuel-air mixture to be passed to the engine for combustion. A conduit is provided for communicating the air-fuel mixture with the inlet manifold for passing the amount of air-fuel mixture called for by the engine.

18 Claims, 10 Drawing Figures

Fig. 4
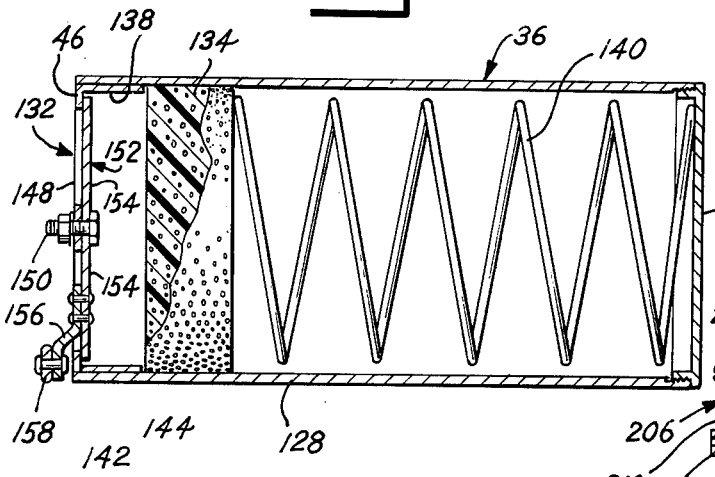
Fig. 5
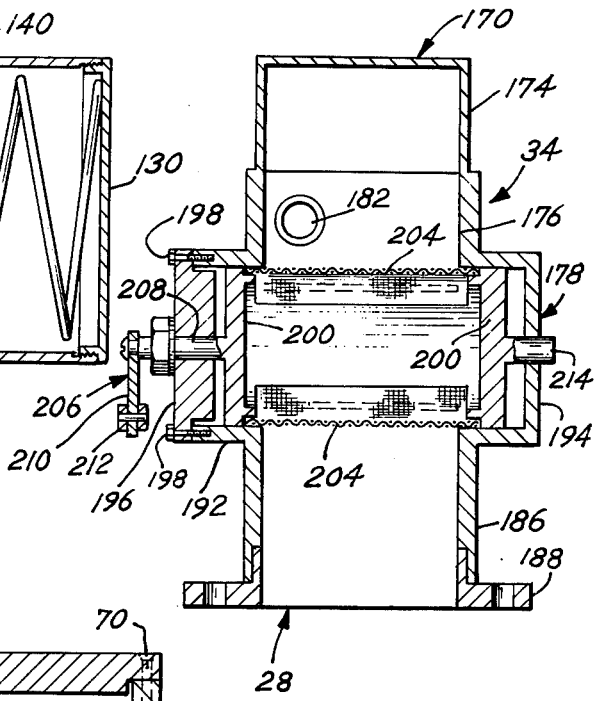
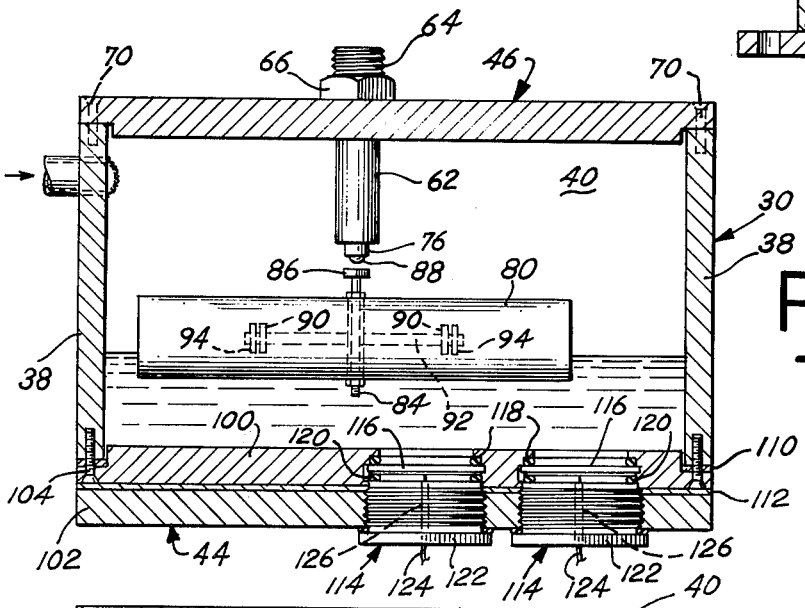
Fig. 6
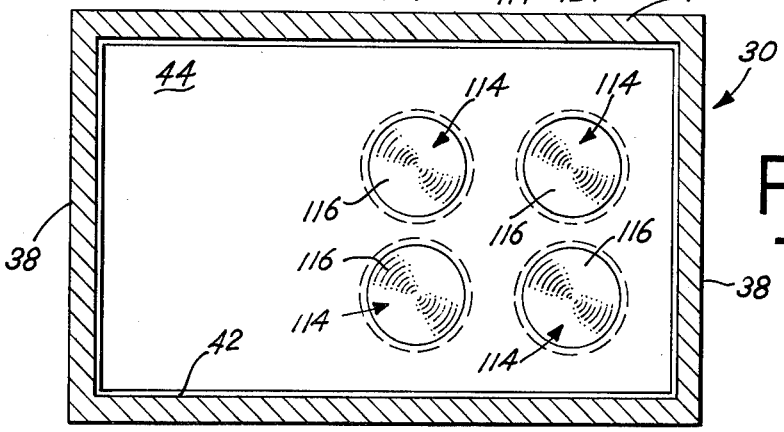
Fig. 7

CARBURETION SYSTEM FOR INTERNAL COMBUSTION ENGINES

BACKGROUND OF THE INVENTION FIELD OF THE INVENTION AND DESCRIPTION OF THE PRIOR ART

This invention relates to a device and system for carbureting liquid fuel for use in internal combustion engines and it particularly relates to such a device and system which ultrasonically vaporizes the liquid fuel, primarily for improving engine efficiency and reducing exhaust pollutants.

In the past few years, the conservation of petroleum type fuels has become a matter of deep worldwide concern, resulting in an international "energy crisis". It is well known that there is only a finite quantity of naturally occuring hydrocarbon fuels, including petroleum and natural gas available, as a natural resource, for energy use. Because of this energy crisis that has occured in the past few years, great efforts have been made to solve and/or alleviate the energy crisis. Generally speaking, these efforts have been directed to two general areas of work. First, work is directed to developing new sources of energy. Secondly, much work is directed to conserving the available world supply of petroleum. The invention herein is primarily directed to alleviating the energy crisis by conserving petroleum energy and specifically by providing a more efficient use of the available energy, particularly liquid fuel, such as gasoline and the like. At the same time, the invention herein is directed to reducing air pollution caused by exhaust gases of internal combustion engines.

It is well known that higher fuel efficiencies in an internal combustion engine using liquid fuels, including gasoline, diesel fuel, jet fuel and the like, should be vaporized or gasified as completely as possible and mixed with the air in a finely divided state before ignition. Prior workers in the field have developed devices for generating vaporized fuel in a highly finely divided state by use of various devices, including devices which produce sound energy.

One device shown in the prior art which utilizes an ultrasonic device for vaporizing or atomizing a liquid fuel is shown in the Hundt U.S. Pat. No. 2,732,835. In this patent, the ultrasonically vaporized fuel is passed directly to a Venturi tube or, alternatively to a conventional carburetor. Other than the use of ultrasonic fuel gasification, the device appears to be conventional.

The Merritt U.S. Pat. No. 3,326,538 shows the use of a vapor generator, not using ultrasonics, for atomizing a fuel wherein the atomized fuel is throttled and the atomized fuel, after being mixed with air, is also throttled.

The Chapman U.S. Pat. No. 2,907,648 suggests that an ultrasonic device can be used in connection with carburetion of liquid fuels for internal combustion engines.

The Vang U.S. Pat. No. 2,414,494 shows a device for creating supersonic vibrations in a system for atomizing a liquid fuel. Ultrasonic energy does not appear to be used.

The Chertoff U.S. Pat. No. 2,745,372 shows a device which creates a siren effect for assisting in atomizing fuel in a basically conventional carburetor.

The Fruengel U.S. Pat. No. 2,908,443 shows the use of an ultrasonic carburetion device utilizing a transistor within an otherwise conventional carburetor of an internal combustion engine.

The Thatcher U.S. Pat. No. 3,533,606 shows an ultrasonic carburetion system wherein an ultrasonic device is located between the intake manifold and the fuel supply inlet. The fuel is drawn across the active surface of the device by negative pressure from the intake manifold of the engine. A fuel supply control mechanism is provided and uses a switching device as a fuel control unit for controlling the fuel supply volume passing to the sound wave producing device. It is believed that the device of the Thatcher patent is also the subject of an article entitled "Ultrasonic Fuel Systems," in the March, 1973 issue of Popular Science, pages 89, 90, 91 and 146.

The Ilford U.S. Pat. No. 3,613,649 shows the use of transducer energization being timed to selectively provide a solid atomized stream of fuel, as required, for use in fuel injection for an internal combustion engine.

The Sweeney U.S. Pat. No. 3,745,983 generally discusses the importance of atomization in achieving optimum air fuel ratios for combustion in an internal combustion engine.

The Hughes U.S. Pat. No. 3,780,945 shows a device which creates pressure waves wherein the device is used in an internal combustion engine to improve fuel atomization for cleaner burning of the fuel and better engine efficiency.

The Sata U.S. Pat. No. 3,860,173 shows the use of an ultrasonic fuel atomizer connecting the intake manifold of an internal combustion engine to a carburetor.

British Pat. No. 508,582 describes a carburetor system and method where atomization of the fuel is affected by the high frequency of vibrations of a member acting upon the fuel, wherein the vibratory action is restricted to the fuel and does not directly act on the combustion air which is mixed with the atomized fuel at a position removed from the surface of the fuel.

British Pat. No. 1,138,536 relates to the use of an ultrasonic device for atomizing fuels in an internal combustion engines.

It is apparent from the prior art that improved atomization of a fuel will provide for better engine efficiency, that is, the degree of combustion of the fuel, and it is also apparent from the prior art that various sound producing devices, including ultrasonic devices, can be used in a variety of ways to accomplish this purpose. However, the prior art devices, as shown in the above-identified patents, are deemed to be deficient in one or more respects. For example, in a number of the prior art devices, modifications of the intake manifold system are required. Prior art devices are also generally deficient in not disclosing a method by which engine demand is sensed for controlling the amount of energy necessary to generate the required fuel.

Also, it is considered a disadvantage that the gasified fuel requires a suitable nozzle arrangement for mixing the gasified fuel with air. Certain of the prior art devices suggests that additional devices, such as an air compressor or pumps are needed. Any such additional costs are, of course, highly disadvantageous.

From the foregoing, it is apparent that a carbureting device and system capable of improving engine efficiency and of reducing engine pollutants, which is simple in construction and which avoids many of the disadvantages of the prior art devices is a significant need in the art, particularly in view of the present concern for the preservation of available hydrocarbon fuels.

SUMMARY OF THE INVENTION

In view of the above it is an important object of the present invention to provide a unique carburetor device and system wherein disadvantages of the prior art carbureting devices are substantially avoided.

It is also an object of this invention to provide a novel carburetion system, using ultrasonic energy, to convert liquid fuel to gaseous fuel, in a highly divided state, wherein the device may be mounted directly on the intake manifold of an internal combustion engine, without any significant modifications to the engine.

It is a further object of this invention to provide a uniquely constructed carburetor device, wherein ultrasonic energy is utilized in order to accomplish the desired fuel atomization, the ultrasonic device being controlled and operated by an electronic control system.

It is yet another object of this invention to provide an improved carburetion system for creating finely divided droplets of liquid fuel for use in an ultrasonic system, wherein electric power for gasification is constantly controlled by an electronic system over a wide range of engine demand.

It is also another important object of this invention to provide an improved carburetion device and system which is particularly characterized by savings in fuel consumption, and by reduction in air pollution.

It is still a further object of this invention to provide a uniquely constructed carburetor device for mounting on the manifold of an internal combustion engine, which device is particularly characterized by its simplicity and economy of construction and manufacture and yet wherein only minor variations are required for utilizing the device for a wide range of automotive and aircraft uses.

It is yet another object of this invention to provide an ultrasonic carburetion system and device which may be utilized on current and past production automotive engines with a high degree of efficiency and safety.

It is also a further object of this invention to provide a uniquely constructed carbureting device which includes safety devices for avoiding flaming or backfiring of the highly atomized fuel.

It is yet another object of this invention to provide an improved carburetor device which by the nature of its construction is highly versatile in location within the space requirements of a wide variety of engines.

Further purposes and objects of the invention will appear as the specification proceeds.

The foregoing objects are accomplished by providing a device for carbureting a liquid fuel for use in an internal combustion engine wherein the device includes a chamber for receiving liquid fuel, an ultrasonic vaporization generator mounted within said chamber for vaporizing the liquid fuel to a finely divided state, a second chamber being provided for continuously storing the vaporized fuel, a channel for communicating the receiving chamber with the storage chamber for passing the vaporized liquid fuel from the receiving chamber to the storing chamber, a device for monitoring the quantity of vaporized fuel in the storing chamber, a member responsive to the monitoring device for controlling the amount of ultrasonic energy required for vaporizing the required amount of fuel, as required by engine demand, a chamber for collecting air, a chamber for intermixing air with the vaporized fuel passing from the fuel storage chamber, a regulator for controlling the quantity of air and vaporized fuel for passage to the intake manifold of the engine for combustion therein, and a channel for passing the regulated mixture from the carbureting device to the engine.

BRIEF DESCRIPTION OF THE DRAWINGS

Particular embodiments of the present invention are illustrated in the accompanying drawings wherein:

FIG. 4 is a sectional view taken along the line 4—4 of FIG. 3 illustrating the interior construction of the air collecting chamber of the carburetor device of FIG. 2;

FIG. 5 is a cross-sectional view taken along the line 5—5 of FIG. 3 illustrating the air-atomized fuel mixing chamber of the carburetor device of FIG. 2;

FIG. 6 is a cross-sectional view taken along the line 6—6 of FIG. 3 illustrating the internal construction of the gasifying chamber, including transducers, for the ultrasonic carburetion of the liquid fuel contained therein;

FIG. 7 is a plan view of the gasifying chamber illustrated in FIG. 6;

DETAILED DESCRIPTION OF THE PREFERRED EMBODIMENTS

Figure 1:
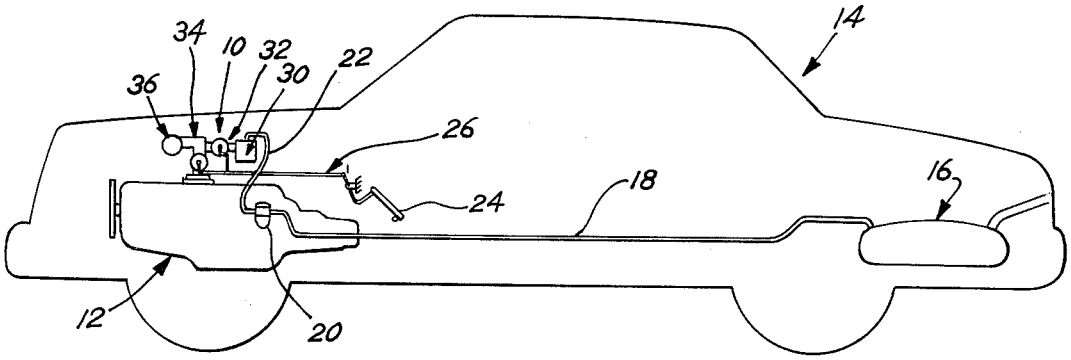
FIG. 1 is a schematic view showing our improved carburetor device, utilizing out unique carburetor system, mounted on the engine of an automobile.

Referring to FIG. 1, our improved carburetor device, generally 10, is shown mounted on a spark ignition, internal combustion engine, generally 12, located within an automobile 14. A conventional fuel tank 16 for gasoline storage is mounted at the rear of the automobile 14. A fuel line 18, also of conventional construction, passes from the fuel tank 16 to a fuel pump 20, located at the front of the automobile 14, near the engine 12. A fuel line 22 interconnects the fuel pump 20 to the carburetor device 10. A gas pedal or speed control device 24 is mounted for operation by the driver within the car and is operatively connected to a linkage, generally 26. The linkage 26 is operatively interconnected to our carburetor device 10.

While throughout this specification, our unique carburetor device 10 and carbureting system will generally be discussed relative to the operation and use thereof in an automobile having a four cycle, spark ignition, internal combustion engine, utilizing a conventional automotive gasoline, it is to be understood that our invention may be used in connection with various types of land and sea vehicles, including automobiles, trucks and boats, in connection with both two cycle and four cycle engines, in connection with both spark ignition engines, while utilizing various types of liquid hydrocarbon fuels which are conventionally vaporized, atomized or gasified for combustion with air in an internal combustion engine, the most common fuel being gasoline although Diesel fuel, kerosene, and the like may be used. Also, the carburetor may be used with any stationary engine employing internal combustion of a hydrocarbon fuel. Also, as will be described hereinafter, our unique carbureting system is useful in aircraft engines with only relatively minor modifications being required of our automotive carburetor.

Constructional materials for the components of the carburetor device 10 may generally be constructed with injection molded plastics. The materials are to be resistant to engine heat and to deteriorating effects of gasoline or the like. Generally, however, the components may be very simple and economically constructed.

Figure 2:
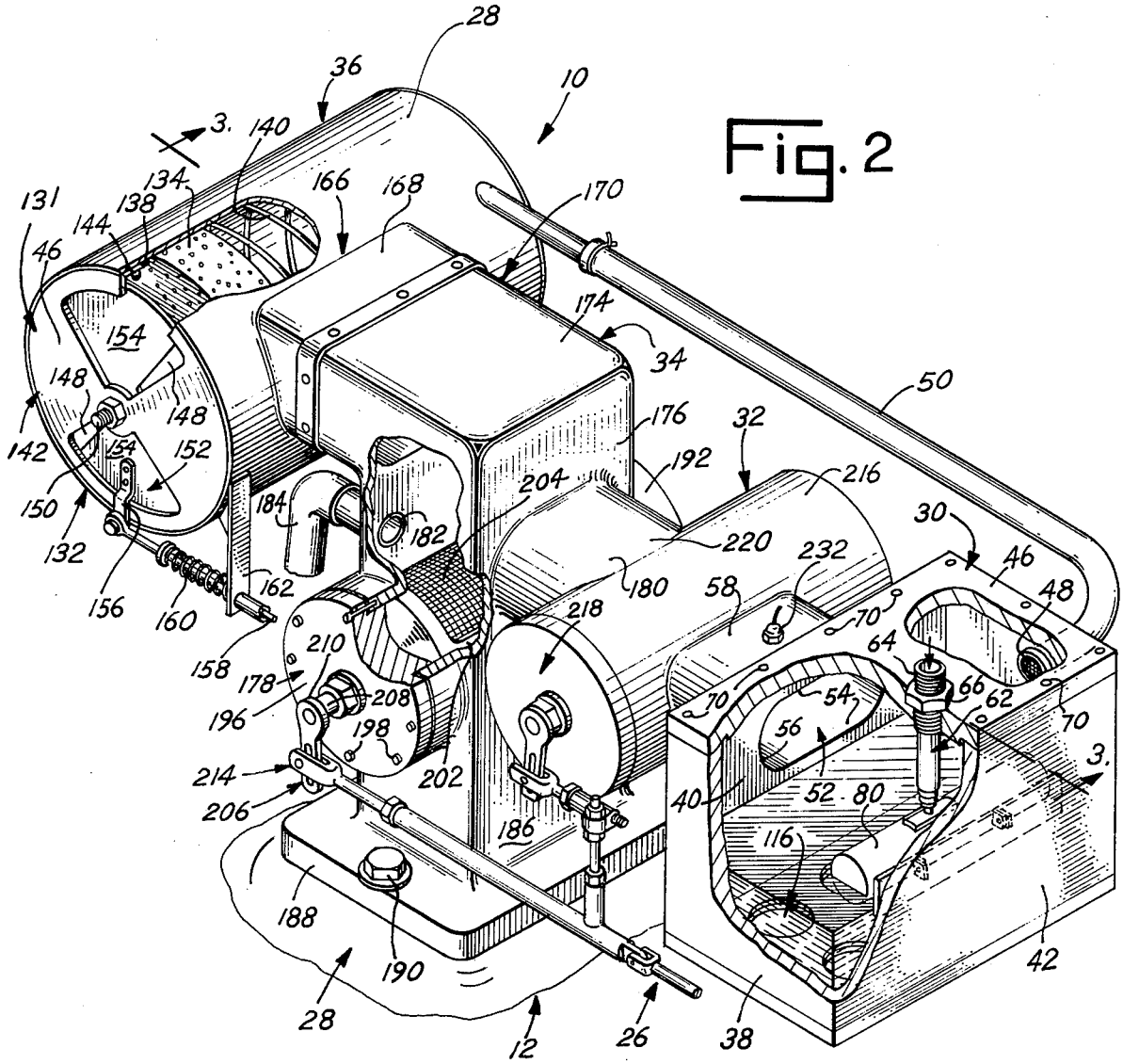
FIG. 2 is a pictorial view of our unique carburetor device for use in connection with the engine shown in FIG. 1.
Figure 3:
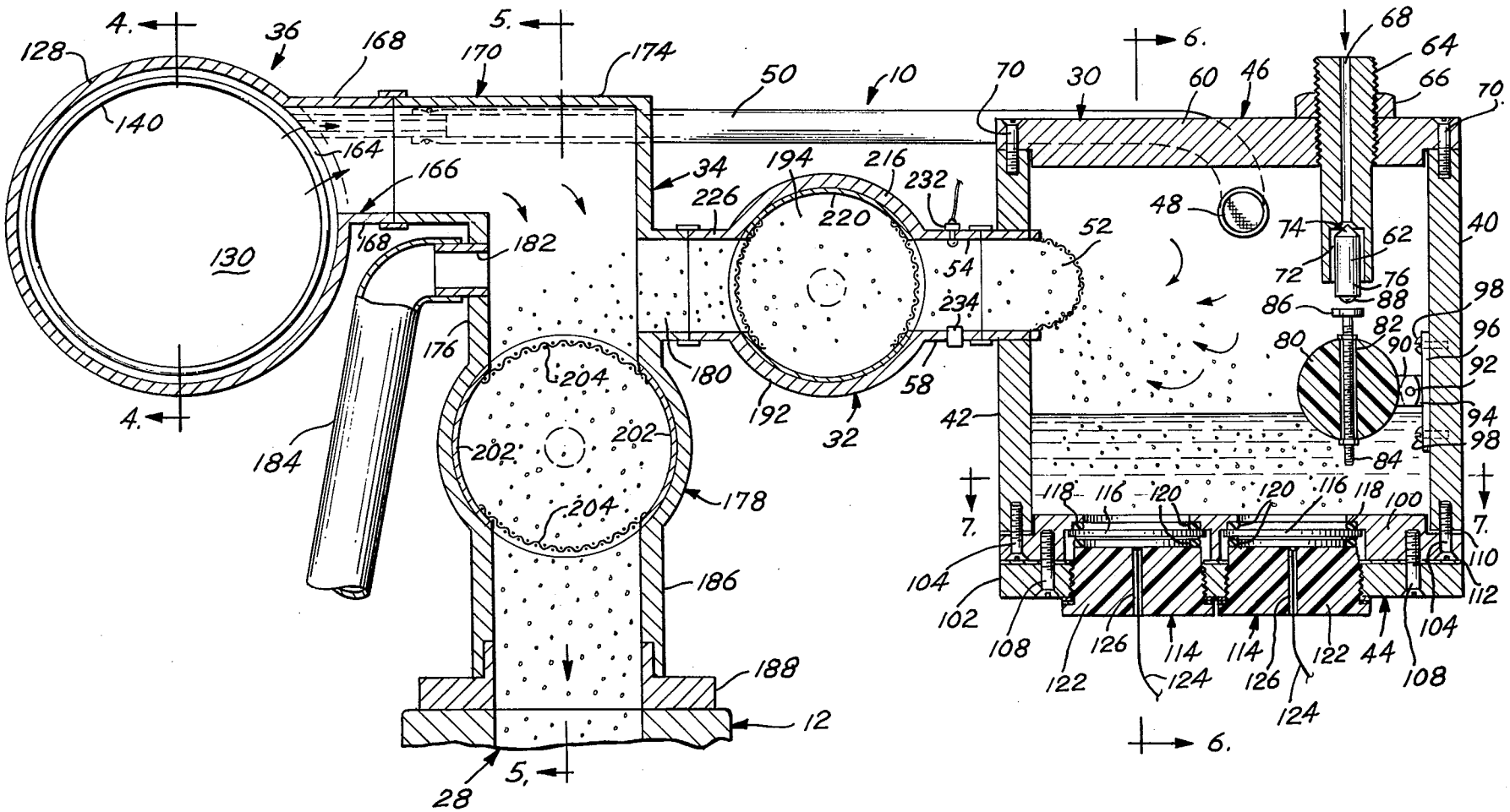
FIG. 3 is a longitudinal, cross-sectional view taken along the line 3–3 of FIG. 2 illustrating the internal construction of the carburetor device of FIG. 2.

Referring to FIGS. 2 and 3, our carburetor device 10 is shown mounted on the engine 12. The carburetor 10 is advantageously mounted on the engine 12 in substantially the same place as a carburetor of the conventional Venturi type, at the same location. Referring to FIG. 3, the air-vaporized fuel mixture is passed directly from the carburetor to the intake manifold 28 of the engine 12 so as to completely replace a conventional carburetor.

The carburetor 10 generally includes a gasifying chamber, generally 30, an interconnected gasified fuel storage chamber, generally 32, an interconnected air and atomized fuel mixing and regulating chamber, generally 34, and an interconnected air collecting chamber, generally 36.

The gasifying chamber 30 is defined by a pair of spaced end walls 38, interconnected by an outer side wall 40 and an inner side wall 42. As seen best in FIGS. 6 and 7, a bottom wall, generally 44, is sealably secured to the bottom edges of the end walls 38 and the side walls 40 and 42. A top wall 46 is secured to the upper edges of the end walls 38 and the outer wall 40 and inner wall 42. One end wall 42 includes an air inlet 48, covered by a screen, which communicates with an air line 50 passing from the air collecting chamber 36. The air passing from the air line 50 is needed in the gasifying chamber as a carrier for the vaporized liquid fuel. The inner wall 42 of the gasifying chamber 30 includes a vaporized gas outlet opening 52, which is covered by a screen (FIG. 3), which functions as a flame trap and which interconnects the gasifying chamber 30 to the gasified fuel storage chamber 32 through a channel 58. In the embodiment shown in FIGS. 2 and 3, the outlet 58 is of an enlarged size, relative to the inlet 48, and is generally horizontally elongated along the top and bottom walls 54 and curved end walls 56. The particular shape and axial length of the channel 58 may be varied over a wide range in accordance with space requirements of the particular engine on which the carburetor device 10 is to be mounted. Preferably, to provide a compact device, the outlet channel 58 is to be as short as possible in length.

The top wall 46 of the gasifying chamber 30 includes a threaded aperture 60 for threadably and sealably receiving a valve body 62. The valve body 62 is a generally upright tubular member and includes a threaded outer periphery 64 which is received in the aperture 60. A lock nut 66 is threadably received by the threaded outer periphery 64 of the valve body 62. The lock nut 66 bears against the top surface of the top wall 46 to permit vertical adjustment for the valve body 62.

The valve body 62 includes a central channel 68 of reduced diameter. The channel 68 communicates with the fuel line 22 for interconnecting the fuel pump 22 to the gasifying chamber 30. A suitable threaded sealed connection (not shown) is provided between the valve body 62 and the fuel line 22.

As seen, for example, in FIG. 3, the top wall 46 defining the gasifying chamber 30 is rigidly secured to the upper edges of the end walls 38 and the outer and inner walls 40 and 42 by a plurality of screws 70 which pass through the top wall 46 and are threadably received within suitable threaded apertures along the upper edges of the walls 38, 40 and 42.

Referring to FIGS. 3 and 6, the valve body 62 includes an enlarged bore 72 in the lower end thereof which is co-extensive with the channel 68. A valve seat 74 is defined in the annular portion at the upper end of the bore 72. A valve stem 76 having a reduced diameter relative to the diameter of the bone 72 is received within the bore 72 for free upper and downward movement therein. The valve stem 76 includes conical upper end which cooperates with the valve seat 74 for controlling the flow of liquid gasoline passing through the valve defined by the valve seat 74 and the valve stem 76.

A substantially cylindrical, horizontal float member 80 is centrally mounted directly below the valve body 62 and the valve stem 76. As seen in the drawings, the float 80, preferably molded of a foamed plastic resistent to deterioration by the fuel, has such a density as to float on the surface of the liquid gasoline contained within the gasifying chamber 30. The float 80 is mounted so its horizontal longitudinal axis is substantially parallel to the outer wall 40 and in close proximity thereto. The float 80 includes a central upright opening 82 through which passes vertical, threaded adjustable rod 84. The rod 84 has a horizontal plate 86 unitarily mounted at its upper end. The relative height of the rod 84 is adjustable relative to the float 80 by a pair of lock nuts secured to the rod 84 in abutting relationship with the walls defining the opposite ends of the upright channel 82. The contact plate 84 is positioned directly below a rounded projection 88 located at the bottom surface of the valve stem 76 so as to move the stem 76 up and down as the float 80 moves up and down as gasoline is added to or passes from the chamber 30. The liquid level of the fuel is to be maintained within close tolerances.

Two laterally projecting ears 90 extend from one side of the float 80 and are pivotally carried by a pivot rod 92 carried by a pair of inwardly projecting ears 94. The ears 94 are rigidly mounted on the inner surface of the outer wall 40 by means of a fixed plate 96 which is secured to the wall 40 by screws 98. The pivot rod, in cooperation with the ears 94 and the ears 90, permits movement of the float 80 about the pivot rod 92 as the liquid level of the gasoline within the gasifying chamber 30 varies depending upon the amount of gasoline passing to the gasifying chamber through the inlet channel 68 and upon the amount of gasoline being gasified within the chamber 30. As the float 80 pivotally rises when more gasoline is being added to the chamber than being gasified, the plate 86, on the rod 84 bears against the projection 88 on the valve stem 76 and thereby causes the valve stem 76 to move upwardly until the flow of gasoline stops as the valve stem 76 seals against the valve seat 74. On the other hand, when more gasoline is being gasified than being added to the chamber 30, the liquid level drops and the float moves pivotally downwardly so as to permit greater gasoline flow to the chamber 30 from the fuel pump 20.

Referring to FIGS. 3 and 6, the bottom wall 44 of the gasifying chamber includes an inner or upper plate 100 which is secured to the lower edges of the end walls 38 and side walls 40 and 42 by means of a plurality of screws 104 passing through the outer periphery of the plate 100 and into suitable threaded apertures provided in the lower edges of the walls 38, 40 and 42. The bottom wall 44 also includes an exterior plate 102 which is secured to the inner plate 100 by a plurality of screws 108. A sealing gasket 110 is interposed between the exterior plate 102 and the bottom edges of the walls 38, 40 and 42 in order to assist in providing a sealed chamber 30 for storing the liquid gasoline. Also, a gasket 112 is located between the plates 100 and 102 to further assure the provision of a sealed container 30 for storing the liquid gasoline.

A plurality of transducer assemblies 114, are secured within the bottom wall 44. The transducer assemblies are an important aspect of the invention as they apply the energy which creates ultrasonic sound energy which gasifies the liquid gasoline. Each transducer assembly 114 includes a plate like transducer 116, each of which is secured in one of a plurality of seats 118 in the plate 102. Each transducer 116 is exposed directly to the liquid gasoline stored within the chamber 30. A pair of O-rings 120 are positioned on opposite sides of each transducer 116 in each seat 118 in order to assure a proper seal and to avoid the leakage of gasoline. A closure plug 122 is threadably mounted within each of a plurality of threaded apertures provided in the plate 102. The upper surface of each plug 122 bears against the lower one of the O-rings 120 so as to securely and sealably maintain each transducer 116 in place in the bottom wall 44 of chamber 30.

An electrical line 124 passes through a narrow channel 124 located centrally of the plug 122. The channel 126 permits the passage of the line 124 therethrough in order to provide that electrical energy is applied to the transducer 116 which, in turn, acts to provide ultrasonic vibration used for gasifying the liquid gasoline contained within the chamber 30. Although, in the embodiment shown, only four transducer assemblies 114 are shown, it is to be understood that any desired number of transducers 116 may be used depending on the given application. The transducer assemblies 114 and bottom wall 44 are specifically constructed and arranged so that the device 10 may be used with any of a variety of internal combustion engines for a variety of purposes.

The air collecting chamber 36, as seen best in FIGS. 2, 3 and 4, generally includes an outer cylindrical wall 128 having an end wall 130, normally closed, and a rotary plate valve, generally 132, operatively mounted opposite the end wall 130. The air collecting chamber 36 has a generally cylindrical hollow interior. At the end of the chamber 36 adjacent the rotary plate valve 132 a substantially cylindrical air filter, or reduced thickness, is mounted. Desirably, the air filter 134 is inserted into the chamber 36 by removal of the choke valve assembly, generally 131. The air filter 134 is desirably received within the seat 138 defined by the cylindrical wall of the rotary plate valve 132. A compression spring 140 having substantially the same outside diameter as the inside diameter of the cylindrical wall 128 is positioned within the chamber 36 and bears against the interior face of the air filter 134 with the opposite end of the spring 140 bearing against the end plate 130. Screws 141 removably hold the assembly 132 in place.

The rotary valve 132 defines a choke valve for the carburetor assembly 10, that is, the rotary plate valve 132 controls the amount of air passing through the carburetor device 10 as required for combustion of the gasified liquid fuel. Referring to FIGS. 2 and 4, the plate valve 132 includes a fixed valve member 142 which is rigidly secured to the cylindrical wall 128, adjacent the seat 138. The fixed valve member 142 includes unitary apertured end plate 146 having a pair of diametrically opposed, arcuate air inlet openings 148, each of the inlet openings having an arcuate length of approximately 90°. A rigid pivot shaft 150 is rigidly mounted at the center of the plate 147 and the shaft 150 acts to rotatably carry a rotatable control plate 152.

The control plate 152 includes a pair of arcuate plate segments 154 which are sized and shaped to substantially cover the arcuate air inlets 148 provided in the plate 147, when desired. One of the segments 154 has a rigid arm 156, secured thereon. The arm 156 is pivotally interconnected, at its outer end, to a control cable 158 which acts to rotate the control plate 152 and thereby the segments 154 so that the amount of air passing through the inlets, is readily controlled. The operation of the cable 158 is by response to automatic control (not shown), as an automatic choke, or to manual operation of a choke in a conventional manner. The cable 158 includes a biasing spring 160 which is carried on a support 162 so as to normally pivotally rotate the control plate 152 to the open position where the arcuate segments 154 are rotatably spaced from the corresponding arcuate air inlets 148 so air can pass therethrough.

As seen best in FIG. 2, an air outlet 164 of reduced diameter is provided in the cylindrical outer wall 128 intermediate the opposite ends thereof, and is interconnected to the air line 50 passing to gasifying chamber 30. The air, under pressure, acts to receive and carry the ultrasonically gasified fuel from the chamber 30, considered an important function. An air conduit 166 of enlarged diameter relative to the air outlet 164 is also located in the cylindrical wall 128 in order to provide an air passage for the major quanitity of air passing through the air collecting chamber 36. The conduit 166 is rigidly interconnected to the air-fuel mixing chamber assembly 34. The air conduit 166 is rigidly mounted over the air outlet 164 and is defined by an outer wall 168, of a substantially rectangular cross-section which intersects with the cylindrical wall 128, as seen best in FIG. 2. The opposite end of the wall 168 is rigidly secured to a connecting section 170 secured to the air-fuel mixing chamber.

The air-fuel mixing chamber assembly 34 includes the rigid connecting section 170 which is positioned vertically above a rotary control valve 178, which interconnects at its lower end to the engine intake manifold 28. The connecting section 170 includes a conduit section 174 which interconnects with the air outlet conduit 166 of the air collecting chamber 36. The conduit 174, in turn, communicates with an upper section 176 and with the rotary valve, generally 178. The upper section 176 also interconnects with the gasified or atomized fuel line 180 passing from the gasified fuel storage chamber 32. As the air stream passing from the air collecting chamber 36 and the vaporized or atomized fuel stream passing from the gas line 180 meet, the two streams intermix and provide the mixture of air and gas for combustion in the engine 12.

The gasified fuel is in a highly finely divided state as a result of the ultrasonic energy imparted to the liquid fuel by the transducers 116 in the gasifying chamber 30.

As seen in FIGS. 2 and 3, it is advantageous to provide an opening 182 in the mixing chamber 176 for the purpose of receiving volatile crank case fumes from a line 184 which is interconnected, at one end to the inlet 182 and its opposite end to a suitable opening in the crank case (not shown) so that the fumes generated within the engine and collected in the crank case (not shown) may be recirculated and burned. These fumes passing through the inlet 182 act to reduce engine pollutants, and also act to improve efficiency.

The lower connector section of the assembly 34 is defined by upright walls 186 which terminate at their lower ends, as seen in FIGS. 2, 3 and 5, at a unitary connecting flange 188 which is rigidly secured to the engine 12, as by bolts 190. The flange 188 is interconnected above and in communication with the engine intake manifold 28, in the same general location as would normally be occupied by a conventional carburetor used on automobiles today. The carburetor device 10 is useful with a wide variety of engines and vehicles and is readily mounted thereon.

The rotary valve 178, as best seen in FIG. 5, comprises a cylindrical outer wall 192 with one fixed end plate 194. An end plate 196 is removably secured to the other end of the cylindrical wall 192 by means of a plurality of bolts 198. A pair of substantially circular rotatable plates 200, having substantially the same outside diameter as the inside diameter of the cylindrical wall 192, are rotatably supported within the cylindrical wall 192. The rotatable plates 200 are interconnected by a pair of cylindrical wall segments 202, as seen best in FIG. 3. The wall segments 202 cooperate with the bottom end of the upper section 176 and the upper end of the outlet conduit 174 to define a control valve for the air-fuel mixture being supplied to the engine 12. The open areas defined between the wall segments 202 include cylindrical screens 204 mounted thereover which serve the important function of acting as flame traps to avoid combustion of the highly volatile mixture which could be caused by back-firing, the fuel being in a highly divided and volatile state because of the ultrasonic vaporization. Preferably, the screens 204 comprise a brass wire mesh sized to resist combustion. Rotary motion is imparted to the valve segments 202 for controlling the quantity of air passing to the engine by means of rotary action imparted thereto by an actuator assembly 206.

The actuator assembly 206 interconnects to a pivot shaft 208 rotatably carried within the removable end plate 196. An arm 210 is fixed to the shaft 208 and the arm 210, in turn, pivotally interconnects with the linkage 26, and specifically with a yoke 212 at the end of the linkage 26. A stub shaft 214 is carried in the fixed end plate 194, as seen best in FIG. 5. Rotary motion imparted to the end plates 200 and thereby to the wall segments 202 controls the flow of air through the openings defined therebetween and enclosed by the screened flame traps 204. The mixture of air and gasified fuel thereafter passes to the engine 12.

The gasified fuel storage chamber 32 is located between the air-fuel mixing chamber 34 and the gasifying chamber 30. The gasified fuel storage chamber 32 includes a cylindrical outer wall 216 in which a rotary valve section 218 is rotatably and operatively mounted. The valve section 218 includes cylindrical wall segments 220 defining a pair of openings 222 which are covered by flame traps or screens 224, which act to prevent combustion of the highly volatile fuel back-firing. The construction of the valve section 218, as mounted within the outer cylindrical wall 216, is substantially the same as the rotary valve of the air-fuel mixing chamber 34 as seen best, for example, in FIG. 5. Therefore, reference is made to the embodiment of FIG. 5 for the detailed construction of the rotary valve section 218.

The outer wall 216 includes an outlet conduit 226 which interconnects with an upper chamber section 176 of the air-fuel chamber 34. An inlet conduit 230 interconnects the valve section 218 to the gasifier chamber 30 and specifically is interconnected to the outlet conduit 52, provided on the inner wall 42 of the gasifying chamber 30.

In the conduit 230 interconnecting the gasifying chamber 30 with the storage chamber 32, there is provided light emitting device 232 and, on the opposite side thereof, a light detecting device 234, responsive to light from the light emitter 232. These devices 232 and 234 cooperate to measure the optical density of the gas being generated within the gasifying chamber 30 as the gas passes to the storage chamber 32. More specifically, the light emitting device 232 and light detector 234 measure the density of the gas passing thereby so as to determine, at any given moment, the quantity of gas being gasified and stored within the storage chamber 32. When the maximum pre-selected gas density is attained, the consumption of electrical energy taken from the engine 12 is automatically reduced by an electronic feed-back control system to be described. The amount of electrical energy transmitted to the transducers 116 is reduced, thereby reducing the amount of gas being generated in the gasifying chamber 30. When the gas density is lowered below a preselected desired level, the transducers 116 recover their full gasifying capacity as more gas is generated by the feed-back control system generating more electrical energy.

In describing the operation of the carburetor device 10 and in describing our carbureting system, reference will be made to FIG. 8, which schematically illustrates the flow of gas and air and the relationship of the electronic control system for controlling gas flow. FIG. 9 schematically illustrates the electronic control system.

Figure 8:
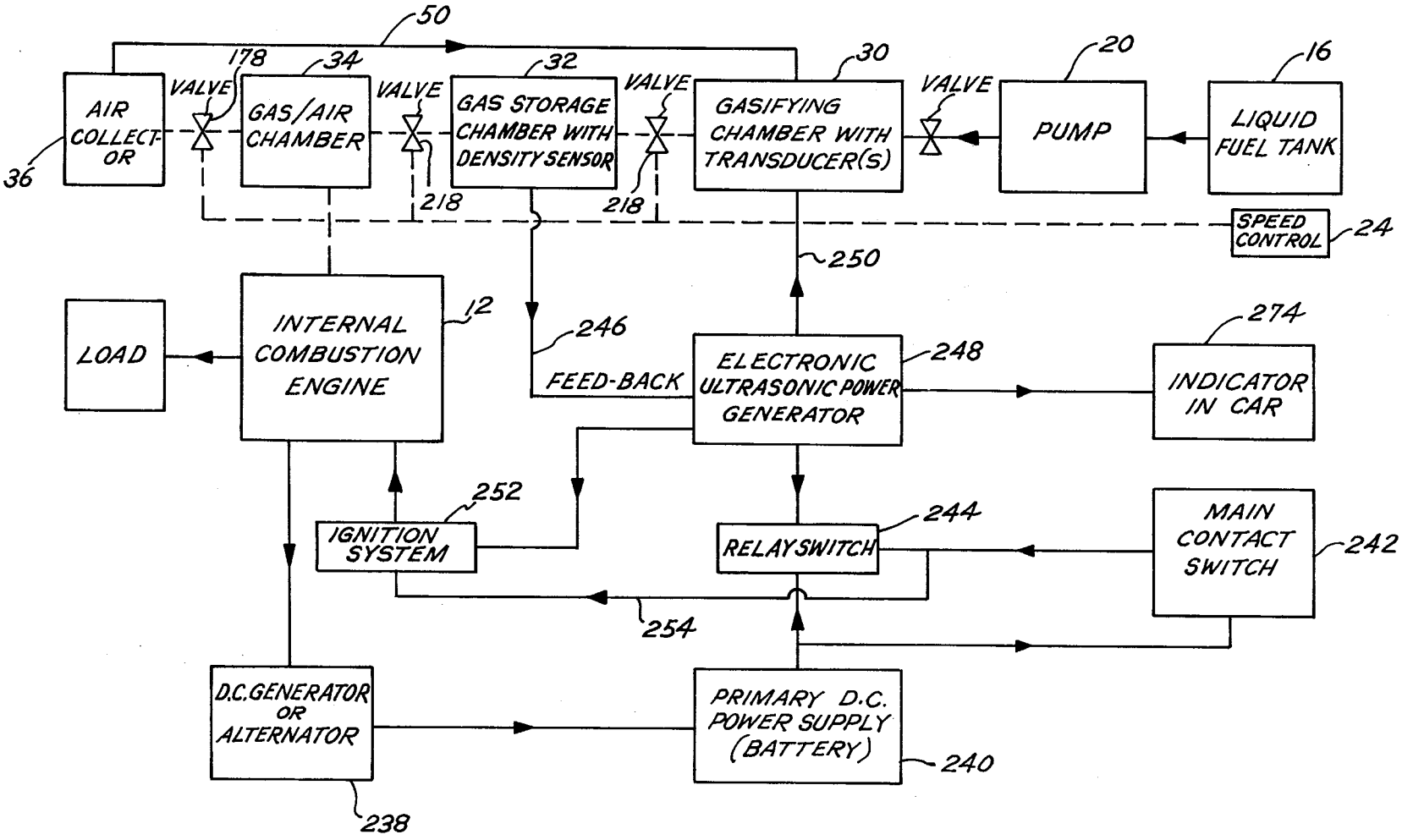
FIG. 8 is a schematic diagram generally illustrating the fuel and electrical flow of our carburetor system.
Figure 9:
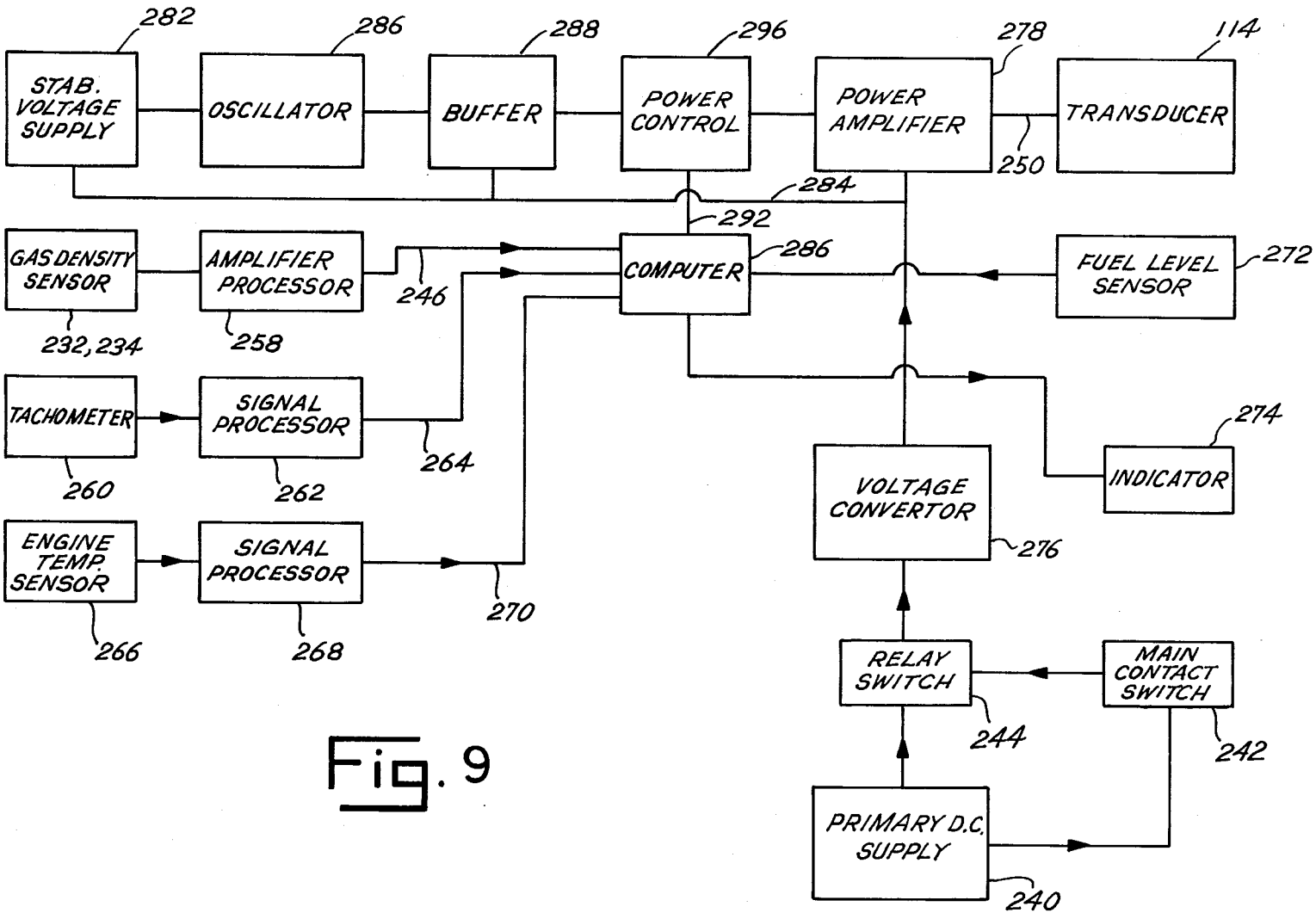
FIG. 9 is a schematic diagram illustrating the electronic power control system utilized in our improved carburetion system, as used in connection with the carburetor device of FIG. 2.

Referring to FIG. 8, the air collector 36 is interconnected, by the air line 50, to the gasifying chamber 30 containing the transducers 116. The air-fuel mixing chamber 34 is interconnected to the air collector 36, the rotary valve 218 controlling the amount of air passing to the air-fuel mixing chamber 34 from the gas storage chamber 32. The valve 218 controls the flow of gasified liquid fuel to the air-fuel chamber 34. Desirably, a valve 236 may be interposed between the gasifying chamber 30 and the liquid fuel pump 20, as shown in FIG. 8.

Outside air is collected by and passes through the air collector 36 and the amount of air passing therethrough is controlled by the rotary plate valve 132 which is controlled by the choke cable 158. It is important for a portion of air to pass from the collector through the line 50 to the gasifying chamber 30 in order that the ultrasonically gasified liquid fuel therein may be entrained in the air stream. The air stream also provides positive air pressure for assisting in moving the ultrasonically gasified fuel to the gas storage chamber 32, to the air-fuel mixing chamber 34 and finally to the engine 12 for combustion. The major quantity of air passing through the air collecting chamber 36 is passed to the air-fuel chamber 34 where the gasified fuel passing from the gas storage chamber 32 is mixed with the air. The air-fuel mixture then passes to the internal combustion engine 12 through the intake manifold 28.

The liquid fuel, such as gasoline, is pumped from the fuel tank 16, by the pump 20, to the gasifying chamber 30 containing the transducers 116. Fuel gasified in the chamber 30 then passes to the gas storage chamber 32, where the vaporized fuel is temporarily stored for sudden demand for power from the engines and thereafter to the air-fuel mixing chamber 34 for mixing with air and for ultimate passage to the engine 12 for ignition.

Referring to FIG. 8, there is schematically illustrated a flow diagram illustrating our carbureting system and which is useful in describing the operation of the engine 12, which operates the load or automobile 14. FIG. 8 particularly shows the main components of the electrical system useful for operation of the engine 12 in connection with out carburetor device 10. The internal combustion engine 12, as is conventional, operates a D-C generator or alternator 238. The generator or alternator 238 is electrically interconnected to a battery or primary power supply 240. Electrical energy needed for engine operation, from both the generator 238 and the battery 240, as is conventional, is electrically interconnected to a main contact switch or ignition switch 242. The contact switch 242 and the battery 240 are electrically interconnected to a relay switch 244.

An electronic ultrasonic power generator, generally 248, is electrically connected to the light density sensors 232 and 234 through the electrical line 246. The ultrasonic power generator 248 is interconnected to the transducers 116 through the electrical line 250. The power generator 248 creates alternating current at the appropriate frequency for operating the transducers 116. The line between the relay switch 244 and the main contact switch 242 is interconnected to the ignition system 252 through the line 254. The ignition system, including spark plugs, is electrically interconnected to the internal combustion engine 12 in a conventional manner.

As the control of the electrical energy imparted to the transducers 116 is important in operating the carburetor device 10, FIG. 9 shows the basic components of the power generator 248, illustrated in FIG. 8, in greater detail as the system relates to the engine components.

An electronic computer circuitry 256 is desirably provided for processing certain electrical signals, as shown, and controlling the power output to the transducers 116, so as to control the amount of gas vaporization. A selected number of signals may be processed by the computer circuitry 256. In this regard, an important signal processed by the computer 256 is that which indicates the vaporized gas density, as indicated by the light emitter 232 and light detector 234 provided in the conduit 228, interconnecting the gasifying chamber 30 with the gasified fuel storage chamber 32. The emitter 232 and detector 234 constantly monitor or measure the optical density of the vaporized gasoline passing from the gasifier chamber 30 to the storage chamber 232. Desirably, an amplifier 258 is located in the feedback line 246 passing from the sensors 232 and 234 to the computer 256. As described earlier, the feed-back signal passing from the sensors to the computer 256 reduces the amount of electrical energy delivered to the transducers 116 as soon as the maximum density for the vaporized gasoline is attained, whereby the computer circuit 256 reduces the electrical energy taken from the engine 12 for operation of the transducers 116, at idling or low power conditions. When the engine 12 is operating at a higher load, more vaporized gasoline is consumed, the gas density is lowered, which is detected by the gas density sensors 232 and 234. The computer 256 detects the reduced density, and indicating that more fuel is required and thereby adds more energy to the transducers 116 for increasing the gasification.

In addition to the important function of processing the signal from the gas density sensors 232 and 234, the computer 256 also advantageously receives a signal from the engine tachometer 260, through a signal processor 262 in the electrical line 264 connected to the computer 256. Additionally, an engine temperature sensor 266 provides a signal for the signal processor 268 in the electrical line 270 to the computer 256. Thus, in addition to the gas density sensor, the computer 256 receives signals from the tachometer 260 and the engine temperature sensor 266 in order for the appropriate electrical energy to be transmitted to the transducers 116. Additionally, a fuel level sensor 272 is interconnected to the computer 256 for indicating the fuel level in the gasifying chamber 30. The signal from the fuel level sensor 272, through the computer 256, further controls the desired amount of electrical energy to be transmitted to the transducers 116. Advantageously, an output signal from the computer 256 may pass to a light indicator 274 which lights when electrical energy being imparted to the transducers 116 is below a preselected level, so the driver of the vehicle is aware of the situation.

The schematic diagram of FIG. 9 also shows the conventional automatic electrical circuitry including the battery 240, the relay switch 244, and the ignition switch 242, as seen in FIG. 8.

The relay switch 244, in FIG. 9, is shown interconnected to a voltage converter 276 which is directly interconnected to a power amplifier 278. The power amplifier 278 is electrically interconnected to the transducers 116 through the line 250. Power to the amplifier 278 is from a circuit which includes a voltage stabilizer 282 which is directly interconnected to the power amplifier 278 through an electrical line 284. The voltage stabilizer 282 is also interconnected to an oscillator 284 and to a buffer 286. The buffer 286 is also interconnected to the line 284 and thereby to the power control unit 299 which delivers a signal to the power amplifier 278 and thereby to the transducers 116. The computer 256 is interconnected to the power control unit 290 through the line 292. The described circuitry controls electrical energy output to the transducers 116 by monitoring engine conditions and by monitoring fuel density, thereby assuring that the proper level of alternating electrical circuit is accurately controlled for optimum engine performance with maximum efficiency from the carburetor 10.

In operating the carburetor device 10, the relative position of the wall segments 202 of the rotary valve 178 has its rotary position adjusted relative to the lower end of the upper mixing chamber 176 to provide a desired amount of flow of air-fuel mixture passing to the engine for highest engine efficiency. In a similar way, the relative position of the valve section 218 of the storage chamber 32 and the wall segments 220 thereof are relatively adjusted to the inlet and outlet openings thereto to provide optimum operating conditions.

It is important to also adjust the relative rotated positions of both the rotary valve 202 and the rotary valve 218 relative to each other, as best seen by the linkage arrangement of FIG. 2. Once the relative adjustment of the rotary valves has been made to each other, the adjustment need not be changed, unless desired at a later time. Thus, the speed control device or control pedal 24 causes the desired rotary motion to be imparted to the valves 178 and 218 in accordance with engine demand, as determined by the operator of the vehicle through the gas pedal or speed control 24.

When operating the carburetor device 10, tests have shown, with a one cylinder, four cycle lawnmower engine, in comparing ultrasonic carburetion with normal carburetion, using exactly the same fuel, that engine efficiency has improved significantly. In one test, at low speed conditions, the engine efficiency with normal carburetion was found to be 4½% with the carburetor device of our invention, engine efficiency was found to be 12.9%, an increment of improvement in efficiency of 2.87 times. Through this figure is probably too high for normal conditions, because of low power levels, in another test the engine efficiency with the normal carburetor was 4.5%, while with the ultrasonic carburetion, engine efficiency was 6% with maximum overload. Thus, initial tests have indicated at least a 40 – 50% improvement in efficiency over conventional carburetion is possible with our invention, even under overload condition. Also, in a test for pollution with ultrasonic carburetion, with an unloaded engine at 3000r.p.m. and an air-gas ratio of 13.5, there was a 2% CO emission. At a fully loaded condition, at an air-gas ratio of 12.4, there was a 6% CO emission, with no visible exhaust smoke.

The ultrasonic carburetion of our device 10 and system, as described, is believed to be the basis for the improvement in engine efficiency because of the finely divided state of the gasoline vapors. When the vapors are mixed with air, they become extremely flammable because of greater surface area where the chemical reaction and combustion takes place. With a finely divided state for the gasoline, in a fixed time period, as when an engine piston is traveling downwards in the combustion cycle, at a constant r.p.m., the fuel can be burned faster and more completely with our invention that with a regular carburetor wherein the fuel droplets are in the order of 100–200 microns. The fuel size resulting from ultrasonic carburetion is believed to be about 5–10 microns. Tests have shown that the engine, using our device and system, runs at higher temperatures than regular carburetion at constant fuel consumption. Higher engine temperatures contribute to a higher efficiency as the mechanical work output depends on the difference between temperatures at the start and at the end of the combustion cycle. Gasification is independent of the engine temperatures and speed or the air density, as the gas, being ultrasonically generated, is independent of the running conditions of the engine. This condition aids starts in cold weather and may be easily adjusted for optimum operating conditions. The amount of carbon deposits is also reduced because the reaction of the fuel with the air is more complete.

In ultrasonically vaporizing fuel, each liquid fuel has an optimum ultrasonic frequency for gasifying the fuel. Also, the amount of vaporization of the fuel per watt of electrical energy to the transducer 116 is an important factor. Generally speaking, the higher the frequency transmitted by the transducer 116, the smaller the vaporized drops will be. A frequency of 1–3 megahertz is considered to be a desirable ultrasonic frequency for gasoline. As the transducers 116 use alternating current, the electrical energy is converted into mechanical energy of the same frequency as the electrical energy. Each transducer 116 is desirably a quartz or ceramic crystal or an electromagnetic device. The transducer is mechanically resonant to the operating frequency in order to attain maximum efficiency of vaporization. The transducers 116 forming the bottom of the vaporizing chamber 30 are in direct contact with the fuel and are cooled by the fuel. The distance between the transducers 116 at the bottom of the chamber 30 and the surface of the fuel is desirably maintained reasonably constant so that the focus of ultrasonic energy is positioned just below the surface of the liquid at all times. A high concentration of ultrasonic energy in a comparatively small volume generates adequate vapors at the surface of the fuel.

The vapors pass from the gasifying chamber 30 by vacuum generated by the engine through the inlet manifold back through the carburetor device 10. Additionally, the pressurized air current provided from the air collector 36 moves the gasified fuel through the device 10.

Generally, a fuel economy in the order of 30 – 50% and a power increase of 10 – 15% by using the device 10 is to be expected under most conditions. Desirably, a plurality of the transducers 116 are utilized as malfunctioning or breakage of one transducer 116 does not result in a complete loss of power. Generally speaking, only foreign solids can contaminate the transducers 116 which could lower their efficiency. However, even if contaminated, the transducers 116 are easily removed and cleaned. In the event that water becomes intermixed as a contaminant with the gasoline, the ultrasonic energy will act to evaporate the water pollutants without significant adverse effect on the engine operation.

Figure 10:
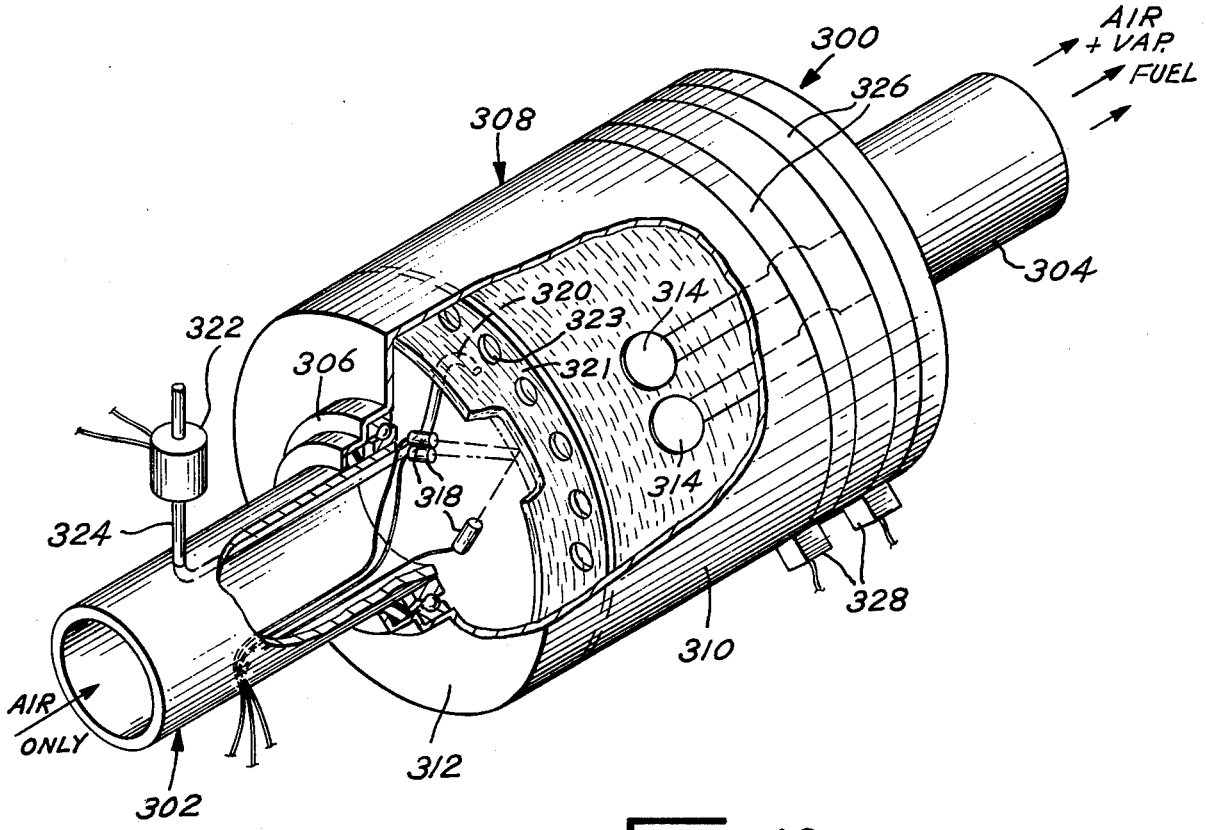
FIG. 10 is an illustration of an alternate gasifying chamber that may be used when the carburetion system of our invention is to be used in aircraft or any engine which operates independently of gravity.

Referring to FIG. 10, there is shown an alternate embodiment of a gasifier chamber 300 which may be utilized with aircraft engines or other engines which are to operate independently of gravity. The gasifier chamber 30 previously discussed, is generally useful only in connection with land vehicles. The gasifier chamber 300 of FIG. 10, however, is unaffected by gravity and is useful in aircraft. A fixed cylindrical inlet tube 302 is axially mounted relative to an outlet tube 304 by sealed bearings 306 which are interposed between each of the tubes 302 and 304 and a rotary drum, generally 308. The drum 308 includes a cylindrical outer wall 310 and a pair of unitary end plates 312. Each of the end plates 312 includes a central opening which is enclosed by the respective bearings 306 in order to provide for a substantially enclosed gasifying chamber within the drum 308.

The inlet tube 302 carries the required air to the gasifying chamber to perform the same function as in the device 10. The outlet tube 304 carries the vaporized fuel from the gasifying chamber 300 to the gasified fuel storage chamber (not shown) which has screen traps as in the device 10. Transducers 314 are mounted on the interior of the rotary drum 308. The level of the fuel within the drum 308, when rotating, is maintained at a constant level by a level sensing device, such as a light emitting diode 318 and photo cells 320 which are sensitive to the light being reflected from the surface of the rotating fuel. An annular plate 321 is provided near the inlet end of the chamber 300. The plate 321 includes openings 323 to permit the passage of fuel. The partition 321 with apertures 323 defines two separate chambers having the same level of fuel therein, the apertured partition 321 avoiding undue fuel turberlence.

Since the rotary drum 318 rotates at a high rate of speed, as the liquid fuel is introduced through the chamber 300 through the tube 324 secured in the inlet tube 302, the fuel moves centrifugally against the inner surface of the cylindrical wall 310 and maintains a fairly constant level as determined by the light device 318 and photo cells 320, and by the apertured partition 321. The two photo cells 320 are desirably electrically interconnected to the electromagnetic fuel pump 322 for controlling the flow of fuel into the chamber 300.

The transducers 314 (116 in regular model) have controlled electrical energy imparted thereto by the use of two spaced contact rings 326, mounted on the outer surface of the cylindrical wall 310. The contact rings 326 are electrically connected internally to the transducers 314 through the wall 310. The contact rings 326 are in electrical contact with two electrical brush contacts 328 which are connected to an electrical external source of energy for applying the desired electrical or electronic energy to the transducers 314 for generating the desired ultrasonic energy for fuel vaporization within the chamber 300. The vaporized fuel passes outwardly through the outlet tube 304, having screens (not shown) defining flametraps.

While in the foregoing there has been provided a detailed description of a particular embodiment of the present invention, it is to be understood that all equivalents obvious to those having skill in the art are to be included within the scope of the invention, as claimed.

What we claim and desire to secure by Letters Patent is:

1. A device for carbureting a liquid fuel for combustion in an internal combustion engine, said apparatus comprising, in combustion, a chamber for receiving said liquid fuel, means for ultrasonically vaporizing said fuel in said chamber, a chamber for temporarily storing said vaporized liquid fuel, means for communicating said receiving chamber with said storing chamber and for passing said vaporized liquid fuel from said receiving chamber to said storing chamber, means for monitoring the amount of vaporized fuel passing to said storing chamber from said receiving means, means responsive to said monitoring means for controlling said ultrasonic vaporizing means for vaporizing the said fuel needed by said engine, means for collecting air, means for communicating said air collecting means with said vaporized fuel storing chamber and for mixing said air with said vaporized fuel, means for regulating the amount of mixed air and vaporized fuel for use in said engine for combustion, and outlet means for passing said regulated mixture of air and vaporized fuel to said engine for combustion.

2. The device of claim 1 wherein said liquid fuel receiving chamber includes means for maintaining a preselected level of liquid fuel in said chamber, and said ultrasonic vaporizing means is located below the surface of the liquid fuel in said chamber.

3. The device of claim 2 wherein said receiving chamber is a cylindrical rotary member and said liquid fuel level maintaining means is maintained at a selected level in said chamber by centrifugal force and by sensing means.

4. The device of claim 2 wherein said liquid level maintaining means includes float means on the surface of said liquid, and valve means operatively connected to said float means for controlling the flow of liquid fuel into said chamber for cooperating in controlling the level of liquid fuel in said chamber.

5. The device of claim 1 wherein said ultrasonic vaporizing means includes transducer means for converting electrical energy imparted thereto into sound energy with selected frequencies for vaporizing said liquid fuel within said receiving chamber.

6. The device of claim 1 including means for directing air to said receiving chamber for entraining said vaporized fuel therein and for acting as a vehicle for carrying said vaporized fuel from said receiving chamber to said storing chamber.

7. The device of claim 6 wherein said air directing means is interconnected to said air collecting means.

8. The device of claim 1 wherein said temporary storing chamber includes a rotary valve having a hollow interior, said regulating means includes a rotary valve having a hollow interior, and means for operatively moving each of said rotary valves for controlling the flow of vaporized fuel from said storing means and for controlling the flow of mixed air and vaporized fuel passing to said engine.

9. The device of claim 8 wherein the relative rotated positions of each of said rotary valves is constant during operation.

10. The device of claim 8 wherein each of said rotary valves includes an inlet opening and an outlet opening, each of said openings being enclosed by a screen member which defines a flame trap for preventing undesired combustion of the volatile mixed air and vaporized fuel in said regulating chamber and of the vaporized fuel in said storing chamber.

11. The device of claim 1 wherein said monitoring means includes sensors for optically measuring the density of the vaporized fuel passing from said receiving chamber to said storage chamber.

12. A device of claim 11 wherein said sensor includes a light emitting member and light responsive member.

13. The device of claim 1 wherein said air collecting means comprises a hollow chamber having a control valve for controlling the amount of air passing through said air collector means, conduit means for passing a selected amount of air to said receiving chamber for receiving vaporized liquid fuel therein, and an outlet means for connection with said communicating means for passing the major portion of said air to said communicating and mixing means.

14. The device of claim 13 including an air filtering means.

15. The device of claim 1 wherein said air from said air collecting means moves in a stream in a direction opposite a stream of vaporized fuel passing from said storage chamber, said air stream and said vaporized fuel stream intermixing in said mixing and regulating means, said mixing and regulating means including a rotary valve positioned therebelow for controlling the flow of mixed fuel and vapor to said outlet means to said engine.

16. The device of claim 1 wherein said outlet means comprises a conduit terminating in a flange, and means for rigidly securing said flange and thereby the carburetor device to the inlet manifold of said engine.

17. The device of claim 1 wherein said ultrasonic vaporizing means includes transducers which are capable for converting electrical energy to sound energy at a wave length for vaporizing said liquid fuel within said receiving chamber.

18. The device of claim 15 including circuitry responsive to the density of gas passing from said receiving chamber to said storing chamber.

* * * * *